US010342734B2

(12) United States Patent
Paruit et al.

(10) Patent No.: US 10,342,734 B2
(45) **Date of Patent: *Jul. 9, 2019**

(54) BAG FOR STORING A THERAPEUTIC SOLUTION

(71) Applicant: Laboratoire français du Fractionnement et des Biotechnologies, Les Ulis (FR)

(72) Inventors: Priscille Paruit, Chatenay-Malabry (FR); Brigitte Chaumeton, Orsay (FR)

(73) Assignee: Laboratoire français du Fractionnement et des Biotechnologies, Les Ulis (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/253,327

(22) Filed: Aug. 31, 2016

(65) Prior Publication Data

US 2018/0049946 A1 Feb. 22, 2018

Related U.S. Application Data

(63) Continuation of application No. 13/392,013, filed as application No. PCT/IB2010/053786 on Aug. 23, 2010, now Pat. No. 9,468,585.

(30) Foreign Application Priority Data

Aug. 24, 2009 (FR) ..... 09 04031

(51) Int. Cl.

| | |
|---|---|
| ***A61J 1/10*** | (2006.01) |
| ***A61J 1/14*** | (2006.01) |
| ***B65D 33/00*** | (2006.01) |

(52) U.S. Cl.

CPC .. *A61J 1/10* (2013.01); *A61J 1/14* (2013.01); *A61J 1/1462* (2013.01); *A61J 2205/10* (2013.01);

(Continued)

(58) Field of Classification Search

CPC .... A61J 1/10; A61J 1/14; A61J 1/1462; A61J 2205/10; A61J 2205/30; B65D 2203/02; B65D 33/004

See application file for complete search history.

(56) References Cited

U.S. PATENT DOCUMENTS 2,895,475 A 7/1959 Cole
3,905,477 A * 9/1975 Graham ..... A61J 1/10 128/DIG. 24

(Continued)

FOREIGN PATENT DOCUMENTS

| | | |
|---|---|---|
| CN | 2882604 | 3/2007 |
| EP | 1031341 | 8/2000 |

(Continued)

OTHER PUBLICATIONS

Ndegwa, Njoroge George et al., "Reflectance, Transmittance and Absorptance of HDPE, LDPE, Glass and Sand Layer Used in a SAH;" International Journal of Applied Physics and Mathematics, vol. 4, No. 6, Nov. 6, 2014.

*Primary Examiner* — Adam Marcetich
(74) *Attorney, Agent, or Firm* — IP Attorneys Group, LLC

(57) ABSTRACT

The invention relates to a bag (10) for storing a therapeutic solution, including at least one compartment (11) for receiving a solution and defined by a diaphragm (12). The bag further includes at least one appendage (13) forming an extension of the diaphragm (12) and comprising a writing area (14). The bag for storing a therapeutic solution according to the invention makes it possible to write on the bag with a reduced risk of contamination.

19 Claims, 1 Drawing Sheet

(52) U.S. Cl.
CPC ..... *A61J 2205/30* (2013.01); *B65D 33/004* (2013.01); *B65D 2203/02* (2013.01)

(56) References Cited

U.S. PATENT DOCUMENTS

| | | | | |
|---|---|---|---|---|
| 3,915,212 | A | 10/1975 | Bujan et al. | |
| 3,993,223 | A * | 11/1976 | Welker, III | B65D 1/095 206/528 |
| 3,994,412 | A * | 11/1976 | Difiglio | A61J 1/10 215/249 |
| 4,150,744 | A | 4/1979 | Fennimore | |
| 4,201,208 | A | 5/1980 | Cambio, Jr. | |
| 5,514,106 | A | 5/1996 | D'Silva | |
| 5,896,989 | A | 4/1999 | Ropiak et al. | |
| 5,998,019 | A | 12/1999 | Rosenbaum et al. | |
| 6,183,460 | B1 | 2/2001 | Smith et al. | |
| 6,199,698 | B1 * | 3/2001 | Hetrick | B65D 75/26 206/484 |
| 6,613,036 | B1 * | 9/2003 | Farmer | A61J 1/10 206/438 |
| 6,764,481 | B1 * | 7/2004 | Inada | A61J 1/10 424/716 |
| 2002/0056989 | A1 | 5/2002 | Lewis-Leander | |
| 2002/0124526 | A1 | 9/2002 | Lewis, Jr. et al. | |
| 2003/0075561 | A1 * | 4/2003 | Pieri | B65D 75/527 222/94 |
| 2003/0080129 | A1 | 5/2003 | Takimoto et al. | |
| 2004/0015147 | A1 | 1/2004 | Mathias et al. | |
| 2005/0012325 | A1 * | 1/2005 | Franko, Sr. | G06K 19/07758 283/81 |
| 2006/0147969 | A1 | 7/2006 | Kuimelia et al. | |
| 2006/0191594 | A1 * | 8/2006 | Py | A61J 1/18 141/329 |
| 2007/0037170 | A1 * | 2/2007 | Nur | A61K 39/39591 435/6.16 |
| 2007/0173435 | A1 | 7/2007 | McGinnis et al. | |
| 2008/0065043 | A1 * | 3/2008 | Bemer | A61J 1/10 604/408 |
| 2009/0036862 | A1 * | 2/2009 | Grimm | B65D 1/0215 604/408 |
| 2009/0118694 | A1 * | 5/2009 | Inuzuka | A61J 1/00 604/410 |

FOREIGN PATENT DOCUMENTS

| | | |
|---|---|---|
| EP | 1245217 | 10/2002 |
| EP | 2033615 | 3/2009 |
| FR | 1348898 | 1/1964 |
| GB | 1415073 | 11/1975 |
| GB | 2358386 | 7/2001 |
| WO | 9219284 | 11/1992 |
| WO | 9403544 | 2/1994 |
| WO | 9742897 | 11/1997 |
| WO | 9514739 | 12/1999 |
| WO | 0029301 | 5/2000 |
| WO | 2009051391 | 4/2009 |
| WO | 2009082132 | 7/2009 |
| WO | 2010034359 | 4/2010 |

* cited by examiner

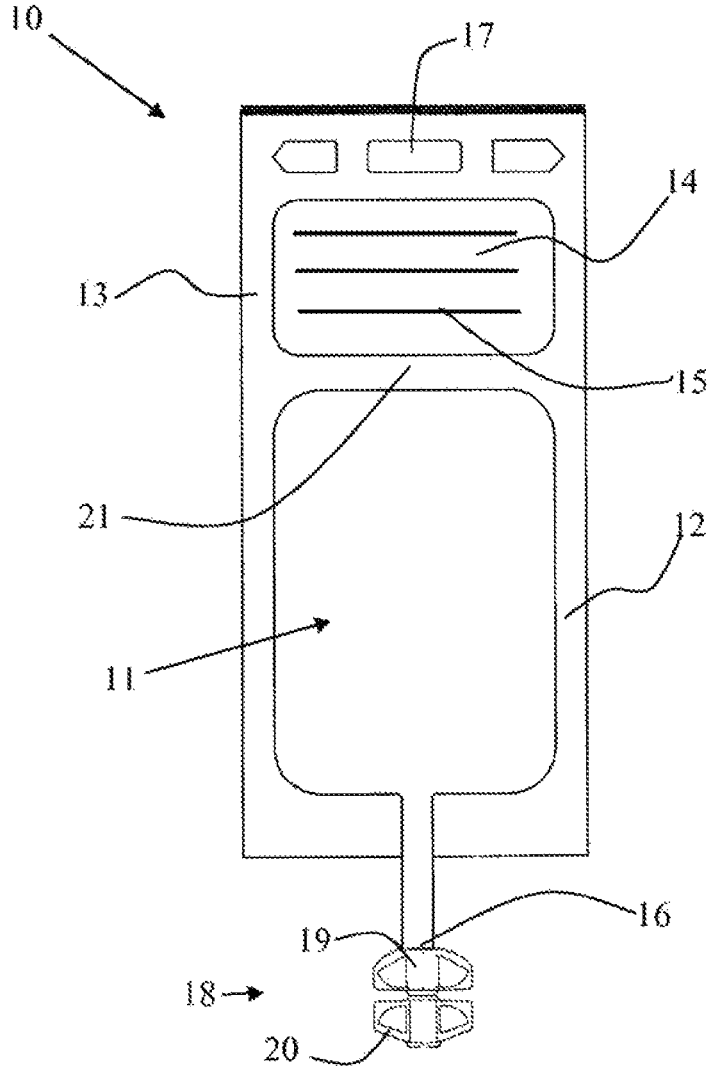
10
17
14
13
15
21
12
11
16
19
18
20

BAG FOR STORING A THERAPEUTIC SOLUTION

CROSS REFERENCE TO RELATED APPLICATIONS

This applications is a continuation of U.S. application Ser. No. 13/392,013, filed Feb. 23, 2012 and titled "BAG FOR STORING A THERAPEUTIC SOLUTION," which claims priority to and the benefit of International Application No. PCT/IB2010/053786, filed on Aug. 23, 2010 and titled "BAG FOR STORING A THERAPEUTIC SOLUTION," which claims priority to and the benefit of French Application No. 0904031, filed on Aug. 24, 2009 and titled "POCHE DE STOCKAGE DE SOLUTION THERAPEUTIQUE." The contents of the above-identified Applications are relied upon and incorporated herein by reference in its entirety.

FIELD OF THE INVENTION

The present invention relates to a bag for storing a therapeutic solution and a method for manufacturing such a storage bag.

TECHNOLOGICAL BACKGROUND

By therapeutic solution is meant any type of product in liquid form used for a therapeutic purpose. It is generally blood components in liquid form, for example blood plasma, platelets, or packed red cells. It can be blood plasma derivatives, for example albumin or an immunoglobulin. It can also be medicamentous solutions, or also nutrient solutions. It can be glucose solution, for example 5%, G5, or also saline solutions, in particular isotonic solutions or also Ringer's solution. It can also be solutions prepared extemporaneously, in particular by adding a medicament to a bag containing a solution of a carrier fluid, typically for the treatment of diseases by intravenous route such as for the treatment of cancer.

Nowadays storage bags represent an alternative to packaging in glass vials for biotechnology products. Commonly used for the intravenous administration of perfusion solutions or for parenteral nutrition solutions or also for blood, flexible storage bags have numerous advantages, in particular that they are light and easy to handle.

Storage bags, like glass vials, are subject to very strict regulation in particular as regards their manufacture and traceability. The bags must in fact bear an inscription providing information relating to the solution, safety data such as the name of the manufacturer, the expiry date, the batch number, the recipient or also the name of the patient, ensuring in particular the traceability of the solution. The bags are generally packaged and sent to hospitals or to any recipient capable of administering the solution to a patient. The patient can himself be the recipient and self-administer the solution.

The bags currently available on the market bear an inscription made directly on a membrane defining a compartment for receiving the solution, as is the case with the flexible bag Flexbumin®, a flexible bag containing human albumin, manufactured and marketed, in particular in Sweden, by the company Baxter. The inscription can also be applied by sticking on a label on which it has been written, printed or stamped beforehand, or also by sticking on a blank label on which the information is subsequently written and/or stamped. The inscription can also be applied directly to the membrane, by handwriting typically with a felt-tip or other pen or with an ink stamp. This is the case in particular when the bag is used to administer a perfusion to a patient. It may prove that during administration the content of the bag is modified, for example by the addition of a medicament, and that the care staff then use a felt-tip pen to make an inscription indicating the modification in question, the quantity to be administered or also the time at which it must be administered.

However, molecules contained in the ink and/or the adhesive used can pass through the membrane and migrate into the therapeutic solution. Such molecules are capable of being toxic to the recipient or of modifying the properties of the solution. Their presence is therefore undesirable and must be avoided. Moreover, the material constituting the membrane is capable of being damaged when the inscription is applied due to the fact that molecules can dissociate from the membrane and contaminate the solution. This contamination of the solution and/or damage to the membrane can be particularly significant in the case where an inscription is applied by hand-writing with a felt-tip or other pen directly on the membrane or on a blank label stuck to the membrane beforehand.

Flexible storage bags are described in Baxter's Patent Application WO 02/072429 and U.S. Pat. No. 4,654,240. Patent Application WO 02/072429 describes a flexible polymeric bag for storing a solution of peptides and/or proteins, as well as a method for introducing such a solution into a flexible polymeric container. The manner in which an inscription is applied to the storage bag is not mentioned in this document. U.S. Pat. No. 4,654,240 describes a laminate film material for a flexible bag capable of storing a product having to be maintained and extracted under sterile conditions. The bag is optionally sterilized with steam. The manner in which an inscription is applied to the storage bag is also not mentioned in this document.

A solution for reducing the risk of contamination in the case where the inscription is applied to the membrane consists of using a particular ink the molecules of which have more difficulty in passing through the membrane. However, such an ink is expensive. Moreover, this solution does not sufficiently reduce the risk of contamination as ink molecules continue to pass through the membrane, and the membrane can always be damaged. Finally, this solution does not address the risk of contamination linked to the inscription applied by sticking on a label. A need therefore exists to reinforce the safety of the batches of therapeutic solution. By means of the present invention the Applicant has surprisingly developed a bag for storing a therapeutic solution, improving the safety linked to the therapeutic solution, and allowing an inscription to be applied to it whilst reducing the risk of contamination.

SUMMARY OF THE INVENTION

To this end, the invention proposes a bag for storing a therapeutic solution comprising at least one compartment for receiving solution delimited by a membrane. The bag also comprises at least one appendage forming an extension of the membrane and comprising an inscription area.

According to preferred embodiments, the storage bag also has one or more of the following characteristics:

- the membrane is transparent;
- the membrane comprises one or more ports;
- the membrane is a multilayer membrane;
- the bag also comprises an impervious and/or opaque outer envelope;

the outer envelope is constituted by a multilayer film containing a layer of aluminium surrounded on both sides by a layer of plastic;

the compartment has a maximum holding capacity comprised between a milliliter and a liter, advantageously comprised between 5 and 500 milliliters, advantageously comprised between 10 and 500 milliliters, more advantageously comprised between 20 and 200 milliliters, and even more advantageously comprised between 50 and 100 milliliters;

the compartment contains a therapeutic solution, in particular albumin or an immunoglobulin, preferably normal immunoglobulin G (NIgG).

The invention also proposes a method for manufacturing a bag for storing a therapeutic solution, previously described, comprising the steps of:

(i) simultaneous formation of the membrane and the appendage, (ii) formation of the compartment by welding, (iii) perforation of the storage bag and optionally formation of the fastening device, (iv) insertion of ports, and sealing of the ports.

The invention also proposes a method for manufacturing a bag for storing a therapeutic solution the compartment of which contains a therapeutic solution or albumin or an immunoglobulin, previously described, comprising the steps of:

(i) filling the storage bag with a therapeutic solution, (ii) sealing of the storage bag filled with the therapeutic solution, by a closure member, (iii) visual inspection of the storage bag filled with the therapeutic solution and closed by the closure member, (iv) applying inscriptions to the appendage of the storage bag containing the therapeutic solution, thus visually inspected, (v) optionally outer packaging of the storage bag containing the therapeutic solution by an outer envelope, and (vi) optionally applying inscriptions to the outer envelope containing the storage bag.

Optionally, the method also comprises a step of irradiation of the storage bag before the filling step (i).

BRIEF DESCRIPTION OF THE FIGURES

The drawings provide:

FIG. 1, a view of a storage bag according to a preferred embodiment of the invention.

DETAILED DISCLOSURE OF EMBODIMENTS OF THE INVENTION

Other features and advantages of the invention will become apparent on reading the detailed description which follows, of an embodiment of the invention, given by way of example only and with reference to FIG. 1.

The invention relates to a bag for storing a therapeutic solution. The bag comprises at least one compartment for receiving the solution. The bag also comprises a membrane, the compartment being the space delimited by the membrane. The bag also comprises at least one appendage forming an extension of the membrane and comprising an inscription area.

The membrane can be constituted by a single piece folded and/or welded so as to delimit the compartment. The membrane can also be constituted by an assembly of several pieces welded together so as to delimit the compartment.

The compartment allows a volume of solution to be received for storage. The inscription area makes it possible to apply an inscription providing information relating to the bag. This information, in non-limitative manner, relates to one or more of the following components: the content of the solution, the producer of the solution and its logo, the seller of the solution, the concentration of the solution, information on the hospital or the establishment or the individual recipient, the name of the patient. The information can be encoded, being presented for example in the form of a bar code or data matrix (matrix constituted by juxtaposed dots or squares, equivalent to a two-dimensional bar code). The inscription can be applied, in non-limitative manner, by handwriting using ink on the appendage, by sticking on or stapling a label printed, handwritten, or stamped beforehand, or also by sticking on or stapling a blank label on which the information is subsequently handwritten or stamped.

As the inscription area is on the appendage forming an extension of the membrane, it is possible to apply an inscription to the bag with a reduced risk of contamination. In fact, applying an inscription to an area of an appendage forming an extension of the membrane and not directly on the membrane in contact with the solution reduces the risk of damaging the membrane and migration of contaminating molecules to the compartment.

In order to eliminate the possible occurrence of migration before marketing, a step of visual inspection is normally carried out. The term "visual inspection" refers to an operation of visually checking the containers intended to detect any contamination or other defects, such as particles, filling errors, pieces of plastic.

The invention is now described with reference to FIG. 1 which shows a view of a storage bag 10 according to a preferred embodiment of the invention.

In this embodiment, the bag 10 comprises a compartment 11 for receiving solution delimited by a membrane 12. The bag 10 also comprises an appendage 13 forming an extension of the membrane 12. The appendage 13 projects in a general manner from the membrane 12, but not necessarily along the axis or in the plane of the membrane 12. The appendage 13 comprises an inscription area 14, which is separate from the membrane 12 in a distinct area. An inscription 15 providing information relating to the bag can therefore be applied with a reduced risk of contamination.

Moreover, in a preferred embodiment, the membrane 12 is transparent. This makes it possible to examine a solution stored in the bag 10 visually or by any other equivalent means. In fact, applying an inscription to an area of an appendage forming an extension of a transparent membrane and not directly to the membrane improves the efficiency of the visual inspection, in particular at the time of filling, as the membrane is free from any printing, but also at the time of use by hospital staff in order to verify the clearness of the solution to be perfused.

In the medical field standards exist which require care staff to take certain precautionary measures before the administration of a therapeutic solution to a patient. An example of such a precautionary measure is carrying out a visual inspection which consists of several steps allowing the care staff to verify visually that no deposit has formed or that no impurity is present in a therapeutic solution before a perfusion. The transparency of the membrane 12 therefore allows the care staff to take precautionary measures requiring the visual inspection of the solution stored in the bag, such as in particular the verification of the colour of the therapeutic solution or the presence of bacterial or particulate contamination within the therapeutic solution to be perfused 10.

The storage bags on the market bear an inscription on the membrane. Apart from the problems of contamination associated with this, an inscription on the membrane constitutes a nuisance for care staff wishing to take the precautionary measures mentioned above. An inscription on the membrane also constitutes a nuisance when the care staff wish to verify the volume of solution contained in the compartment 11, for example in order verify that a perfusion is proceeding correctly. Furthermore, the presence of this inscription on the membrane constitutes a nuisance when carrying out a visual inspection of the therapeutic solutions.

In the bag 10 represented in FIG. 1, the inscription area 14 is separate from the transparent membrane 12. There is therefore no inscription to be a nuisance to the eye, which facilitates and as a result speeds up the work of the care staff. Great importance is attached to facilitating the work of the care staff in particular in emergency care.

In another variant, the membrane 12 is not transparent but, on the contrary, opaque in order to protect the solution from light irradiation. This can be the case when the solution stored in the bag 10 is not administered directly, but sampled for example using a syringe before being administered. In this case, the precautionary measures mentioned above can be taken after sampling the solution in the syringe. It is also possible for the solution to be administered from the bag 10, in this case the opaque membrane.

One of the embodiments of the invention uses an appendage surface area/storage bag surface area ratio comprised between 0.15 and 0.40, preferably between 0.20 and 0.35, in particular between 0.25 and 0.30 in particular equal to 0.27.

The membrane 12 in FIG. 1 comprises a port 16. The port 16 allows the injection of a solution for storage into the compartment 11. The port 16 also allows the flow of a stored solution out of the compartment 11 for administration to a patient by perfusion. In the case of such a use, the port 16 is connected to a line, not shown, administering the solution to a patient. Typically, the line connects the compartment 11 to one of the patient's veins. The port 16 can also be used as an access route for sampling a certain quantity of solution using a syringe or another sampling device. The port 16 can also be used as an access route for the injection of a given quantity of a medicament, such as for example for the treatment of cancer patients, for whom a solution of active ingredient is injected into the bag, optionally after reconstitution by the medical staff.

The membrane can also comprise several ports. For example the membrane can comprise two ports: a first port for the injection of the solution into the compartment for storage, and a second port for the flow of the solution out of the compartment for administration to a patient. In this case, a bag comprising several 10 ports makes it possible to add components to a solution stored in the bag via the first port at the same time as the solution is flowing via the second port during the perfusion.

The port 16 is advantageously situated in an area opposite the appendage 13 with respect to the compartment 11. In this case, the appendage 13 can be provided with a fastening device 17, as is the case in the embodiment in FIG. 1. In this embodiment 1, the fastening device 17 is constituted by a hole through the appendage 13. This configuration is however not limitative. In fact, there can be a different number of holes. Moreover, other types of fastening devices, such as for example a magnet, a hook projecting from the appendage 13 or also an adhesive can be used. Similarly, it is possible to have a pre-cut hook in the appendage 13, which can be opened out in order to allow fastening.

The fastening device 17 makes it possible to suspend the bag from a support preferably situated high up. As the port 16 is situated in an area opposite the appendage 13 with respect to the compartment 11, the suspension of the bag 10 by the fastening device 17 allows the flow of the solution out of the compartment 11 through the port 16 under the effect of gravity. The bag 10 can thus be suspended above a patient and be used as a perfusion bag. Therefore, by "area opposite the appendage with respect to the compartment" is meant the area of the membrane 12 which is lowest when the bag is suspended by a fastening device 17 of the appendage 13.

In the case where the membrane 12 comprises several ports, the port or ports intended for the flow of the solution out of the compartment 11 are situated in an area opposite the appendage 13 with respect to the compartment 11, which ensures the flow of the solution under the effect of gravity.

In a variant, the flow of the solution occurs using a pump, or even by compression of the compartment 11, in particular in the perfusion pump-assisted perfusion mode. In this variant, the port 16 can just as well be situated in an area opposite the appendage 13 with respect to the compartment 11 as in another area, as gravity is longer necessary to ensure the flow of the solution.

The port 16 is provided with a closure member 18. This closure member makes it possible to prevent an unwanted flow of the solution.

Typically, after the injection of solution into the compartment 11 through the port 16, the port 16 is provided with the closure member 18, for example by welding a fixed part 19 of the closure member 18 around the port 16. When the bag is used, for example for a perfusion, a removable part 20 of the closure member 18 is removed by breaking a breakable joint between the fixed part 19 and the removable part 20. Typically the joint can be broken by rotating the removable part 20 relative to the fixed part 19. This is referred to as a "twist-off" mechanism. A breakable joint allows rapid use of the bag 10.

Configurations different from that shown can however be used for the closure member 18. For example, the fixed part 19 can be closed by the removable part 20, or by another component, although the latter has been removed beforehand using for example a screw mechanism. This configuration makes it possible to close the port 16 despite the fact that the solution has first started to flow. This configuration is useful for example when it is desired to temporarily interrupt a perfusion.

The membrane 12 is preferably made of a flexible material. This is advantageously a plastic material. It is possible to use PVC, polyethylene, polypropylene or any other material commonly used for producing flexible bags. The thickness of the films is standard.

In a preferred embodiment, the membrane is made of polypropylene.

The flexibility of the bag 10 allows easier storage of the bag 10, simpler waste removal, as well as greater ease of use compared with rigid vials. Moreover, as the membrane is made of a flexible material, it is unbreakable, thus avoiding problems of decontamination associated with the use of glass vials.

The membrane 12 can also be constituted by multilayer, in particular three-layer, films, the materials constituting the different layers having specific functions, for example as a barrier (for example a barrier against oxygen or against the perfusion product), support, binder between two layers, etc. A use of several layers makes it possible to further reduce the risk of contamination and increase the resistance abilities of the membrane 12, in particular to physical stresses and to beta irradiation. Use of three layers allows a compromise between an increase in resistance and preservation of the transparency of the membrane 12.

The bag can also be placed in an outer preferably impervious removable envelope. This outer envelope has the advantage of constituting a physical barrier against loss of water. Furthermore, this outer envelope, if it is opaque, protects the solution from possible light-induced denaturation. Such an outer envelope is particularly advantageous in the case where the solution stored in the bag 10 is albumin or an immunoglobulin for example, particularly sensitive to light.

In the case of storage of an immunoglobulin, the immunoglobulin can be manufactured according to the method described in the documents FR-2824568-A1 and FR-2895263-A1. It can be an intravenous immunoglobulin G (IVIg).

The outer envelope can also be constituted by multilayer, in particular three-layer films, the materials constituting the different layers having specific functions, for example that blocking the light, or also that of ensuring imperviousness. The outer envelope can be made of aluminium or plastic or a mixture of the two. The outer envelope can be thermoformed around the storage bag 10.

In a preferred embodiment of the invention, the outer envelope is constituted by a multilayer film containing a layer of aluminium surrounded on both sides by a layer of plastic, for example polypropylene, which makes it particularly shock-resistant, and constitutes a barrier against the light. According to a preferred embodiment of the invention, the outer envelope is constituted by a layer of polyethylene, a layer of aluminium and a layer of polypropylene.

Typically, a storage bag 10 according to the invention containing a therapeutic solution is packaged in the outer envelope then sent to a recipient. Before using the bag 10, the recipient removes the outer envelope. Thus, the envelope constitutes an additional protection until it is removed, i.e. until the bag 10 is used.

The compartment 11 has a maximum holding capacity comprised between one milliliter and one liter, advantageously a maximum holding capacity comprised between 5 and 500 milliliters, advantageously comprised between 10 and 500 milliliters, and even more advantageously comprised between 20 and 200 milliliters, advantageously 50 and 100 milliliters. For example, the bag has a maximum holding capacity of 100 milliliters.

In the case where the membrane 12 is transparent, thus making it possible to visually examine the solution in the compartment 11, the invention is all the more useful the smaller the volume of the compartment 11. In fact generally, the smaller the volume of the compartment 11, the smaller the surface area of the membrane 12, and the more any inscription applied to the membrane 12 constitutes a nuisance.

The bag 10 comprises a weld separating the membrane 12 from the appendage 13. In the case where the bag is made of a flexible material and where it is filled with a solution, the weld gives a flexibility to the appendage 13 relative to the compartment 11. This flexibility is useful in particular in the case where several bags storing a solution are arranged in a storage box. The inscription 15 being applied to an inscription area 14 of the appendage 13, it is possible to identify a bag without removing it from the box. The work of the care staff is thus facilitated.

In another embodiment not shown, the bag comprises several compartments for receiving solution. A membrane delimits the compartments and, as in the embodiment in FIG. 1, an appendage forms a (projecting) extension of the membrane. Whether in this embodiment which is not shown or in the previous one, there can be several appendages forming the extension of the membrane, after one another or side by side, superimposed on each other. This makes it possible to apply several inscriptions to the bag. For example this makes it possible to apply an inscription to each compartment when the bag comprises several compartments.

In the embodiment where the bag comprises several compartments, the bag can be provided with a mixer ensuring a mixture of the content of the different compartments, the mixture then flowing through the port. The bag can also be provided with a port for each compartment, a mixture then being ensured by a mixer outside the bag.

The novel flexible bag according to the invention is manufactured by any standard method for manufacturing flexible bags. In general, the compartment 11 is prepared by welding according to a predefined design, by welding a membrane folded back on itself or two distinct films. A membrane seal is provided during the welding, in standard fashion. The welding can also be done in standard fashion, by thermowelding or ultra-sound. The appendage forming a (projecting) extension can be fixed by welding to an existing bag or, conversely, obtained directly during manufacture. The membrane folded back on itself can be continued in order to form the appendage; it is also possible for the two films to be welded together to form the appendage, or also for a single one of the films to be extended to form the appendage. According to an embodiment, the bag comprises a weld 21 in between, separating the membrane from the appendage.

For example, a method for manufacturing a bag according to the invention can comprise the steps of:

(i) Simultaneous formation of the membrane and the appendage, (ii) Formation of the compartment by welding, (iii) Perforation of the storage bag and optionally formation of the fastening devices, (iv) Insertion of ports and sealing of the ports.

The method for preparation of the bag comprises the following steps (after the last step of the method for manufacturing the bag):

(i) Filling the storage bag with a therapeutic solution, (ii) Sealing of the storage bag filled with the therapeutic solution by means of a closure member, (iii) Visual inspection of the storage bag filled with the therapeutic solution and closed by the closure member, (iv) Applying inscriptions to the appendage of the storage bag containing the therapeutic solution, thus visually inspected, (v) Optionally outer packaging of the storage bag containing the therapeutic solution with the outer envelope, (vi) Optionally application of inscriptions to the outer envelope containing the storage bag.

The method can comprise a step of irradiation of the storage bag before the filling step (i) in order to sterilize the bag. In preferred manner, beta irradiation is carried out at 25 kilograys. The method can comprise an intermediate step of pasteurization and/or incubation of the storage bag containing the therapeutic solution, after step (ii) of sealing and before step (iii) of visual inspection of the storage bag. Advantageously, the method comprises an intermediate step of pasteurization and incubation between steps (ii) and (iii).

EXAMPLES

The following examples illustrate the invention without limiting it.

In the examples, the bags tested are according to FIG. 1. These are bags sterilized beforehand by β-irradiation, at 25 kGy. The membrane 12 is in each case transparent, comprises a port 16 provided with a twist-off mechanism, and is a multilayer membrane, constituted by three polypropylene layers. The bag 12 also comprises an outer envelope constituted by a multilayer film containing a layer of aluminium surrounded on both sides by a layer of plastic. The layer of aluminium has a thickness of 8 μm. The layers surrounding the layer of aluminium are made of polypropylene terephthalate and polypropylene and have a thickness of 12 μm and 75 μm respectively. The outer envelope (also called an "over-bag" hereafter and in the figures) is thus impervious and opaque. The outer envelope has a width of approximately 160 mm and a length of approximately 270 mm. The compartment 11 has a maximum holding capacity approximately equal to 100 milliliters. In both cases also, information is pre-printed onto labels, and for each bag, a label is then stuck onto the inscription area (14) of the appendage (13) forming an extension of the membrane (12), and another label is stuck onto the outer envelope.

Example 1: Study of the Stability of 20% Albumin Stored in Test Bags

1. Material

In this test, 20% albumin is stored in the compartment of the test bags. The bags are grouped together in different batches controlled/monitored independently. Within a batch, the volume of albumin is uniform and is approximately equal to 50 or to 100 ml depending on the batch (The term "50/100 ml presentation batch" is used hereafter, depending on the capacity of the bags in the batch in question).

The bags are placed in controlled-temperature and -humidity enclosures according to two sets of experimental conditions (SEC):

SEC 1: temperature of +25° C.±2° C., relative humidity (RH) of 40%±5%,

SEC 2: temperature of +40° C.±2° C., RH<25%.

The bags are sampled at scheduled time points for analysis. These analyses are carried out in the following order:

a) before preparation (Tbp), i.e. at the PBRM (Purified Bulk Raw Material: pre-heated stabilized albumin) step, b) after preparation (Tap), i.e. after distribution into bags, c) after pasteurization, incubation and secondary packaging with the over-bag (TO), and d) every month for six months.

The analyses can be classified in three categories according to their characterization: qualitative, microbiological or functional. The qualitative characterization of the bags focuses on the appearance of the solution (colour, degree of opalescence), pH, osmolality, the concentration of polymers, aggregates, enzymatic degradation products, sodium, potential adsorption of the stabilizer which is sodium caprylate, study of the migration of the highly toxic component of the over-bag that is aluminium, study of the prekallikrein activator, observation of the presence of water between the membrane and the over-bag, measurement of the extractable volume and monitoring of the weight of the bag in order to reveal any loss of water during storage. The microbiological characterization focuses on the sterility. The functional characterization focuses on the total protein content (active ingredient content).

Table I summarizes the different analyses and provides for each one the method used and the acceptance criterion applied.

TABLE I

Analysis, method and application criterion applied

| Analysis | Method | Acceptance criterion |
|---|---|---|
| Appearance of the solution | Ph. Eur 2.2.2 | Practically colourless, |
| Colour | Ph. Eur 2.2.1 | yellow (Y, YB ≥ YG3) |
| Degree of opalescence | | Clear |
| pH | Ph. Eur 2.2.3 | 6.7-7.3 |
| Osmolality (mOsmol/kg) | Ph. Eur 2.2.35 | 200-300 |
| Total proteins (g/l) | Ph. Eur 2.5.33 method 5 | 190-210 |
| Polymers and aggregates (%) | Ph. Eur 2.2.29 | ≤5 |
| Sodium caprylate (mg/g proteins) | Ph. Eur 2.2.28 | 12.80-16.80 |
| Sodium (mmol/l) | Ph. Eur 2.2.22 | 114-126 |
| Degradation proteins (%) | Ph. Eur 2.2.29 | ≤5 |
| Extractible volume | Ph. Eur 2.9.17 | ≥nominal volume |
| Prekallikrein activator (IU/ml) | Ph. Eur 2.6.15 | ≤35 |
| Sterility | Ph. Eur 2.6.1 | Sterile |
| Aluminium (μg/l) | Ph. Eur 2.2.23 method I | ≤200 |
| Monitoring of the weight of the bag with reference over-bag | Weighing | NA |
| Presence of water between the membrane and the over-bag | Visual observation | NA |

The results obtained for each analysis are compared with the criteria for acceptance of the product at each time point. Moreover, changes in the active ingredient content (total proteins) are studied by linear regression according to the ICH QIA recommendations (based on 5 time points). The absence of a linear regression ($p>0.05$) reveals the absence of change in the results studied over time.

2. Results

Sec 1 Batches

Table II shows the results for a 50 ml presentation batch subjected to all of the SEC 1 conditions, the batch being representative.

Whatever the batch and the presentation (50 ml or 100 ml), the total protein contents observed at each time point meet the acceptance criterion.

Statistical analysis of the results reveals the absence of change in the total protein contents as a function of storage time for all of the batches, with the exception of one 100 ml presentation batch for which a reduction in the total protein contents is observed over time (existence of a linear regression, $p<0.05$). But this reduction does not affect the quality of the product, given the compliance of the results obtained at each time point.

Moreover, irrespective of the batch and the presentation (50 ml or 100 ml), the results obtained at each time point meet the acceptance criteria, with the exception of the sterility of one of the 50 ml presentation batches at the 6 month time point. However after investigation, the observed absence of sterility proved to be probably linked to a defect in the imperviousness of the bag. In fact, a sterility test carried out on a bag sampled at a time point of approximately 9 months gives a compliant result.

Also, irrespective of the batch and the presentation (50 ml or 100 ml), after 6 months no change is found in the weight of the reference bags (including over-bags), and no abnormal presence of water was found between the membrane and the over-bag.

SEC 2 Batches

Table III shows the results for a 100 ml presentation batch subjected to all of the SEC 2 conditions, the batch being representative.

Irrespective of the batch and the presentation (50 ml or 100 ml), the total protein contents observed at each time point meet the acceptance criterion.

Statistical analysis of the results reveals the absence of change in the total protein contents as a function of storage time for all of the batches, except for one 50 ml presentation batch and one 100 ml presentation batch, for which a reduction in the total protein contents is observed over time (existence of a linear regression, $p<0.05$). But this reduction does not affect the quality of the product, given the compliance of the results obtained at each time point.

Moreover, irrespective of the batch and the presentation (50 ml or 100 ml), the results obtained at each time point meet the acceptance criteria, with the exception of the sterility of one of the 100 ml presentation batches at the 6 month time point. But after investigation, the observed absence of sterility proved to be probably linked to a defect in the imperviousness of the bag. In fact, the result of a sterility test carried out on a bag sampled at a time point of approximately 9 months meets the criteria.

Also, should a loss of water occur during storage, it would be confirmed by an increase in pH, osmolality and sodium content values, which is not the case.

Conclusion

It can be concluded from the results obtained that the 20% albumin stored in the flexible bags tested, in 50 ml and 100 ml presentations, is stable:

for 6 months at a temperature of 25° C.±2° C., for 6 months at a temperature of 40° C.±2° C.

Example 2: Study of the Stability of 5% NIgG (Normal Immunoglobulin G) Stored in Test Bags 1. Material The notations of Example 1 are used again. The compartments of the bags are filled manually using a peristaltic pump, with 50 ml of 5% normal immunoglobulin G (NIgG) manufactured according to the method described in the documents FR-2824568-A1 and FR-2895263-A1, covered with over-bags and stored under SEC 1 conditions (i.e. 25° C.±2° C. RH=40%±5%) or SEC 2 (i.e. 40° C.±2° C. RH<25%). In parallel, glass vials are filled with the same quantity then stored under the same conditions for reference.

The analyses carried out are aimed firstly at verifying the stability of 5% NIgG in the bags and any loss of water during storage, resulting from water diffusion through the multilayer membrane of the bag.

The analyses are carried out at TO and after storage for 1 month and 3 months, at 25° C. and 40° C. The methods used are those recommended by the European Pharmacopoeia as regards the appearance of the solution (degree of opalescence and colour), the pH, the osmolality, the total protein contents (HPSEC, Anti-Hbs activity, AAC). Moreover, assay of the fragments (<3%), evaluation of the presence of visible and sub-visible particles, and Tween 80 assay are also carried out. The appearance of the bag (flexibility of the membrane, transparency, imperviousness of the welds, presence of water between membrane and over-bag) is also monitored.

Secondly, the container/content interactions are evaluated.

For this, the extractables and leachables are assayed, according to the "Guideline on Plastic Immediate Packaging Materials" (CPMP/QWP/4359/03).

The extractables study is carried out with four extraction matrices (purified water for injectable solutions, NaOH, HCl and ethanol), at 100° C., over 5 hours. Only the antioxidants are sought. As this study is carried out on non-irradiated bags, a study is also conducted on bags γ-irradiated at 50 kGy. Purified water for injectable solutions is used as extraction medium in this study.

The substances leaching from the bags of NIgG stored for 3 months at 25° C. and 40° C. are assayed, in light of the results of the extractables study. The analyses are semi-quantitative in nature, which means that the assays have not been validated beforehand. For the techniques requiring extraction (in dichloromethane) of the potentially leached organic compounds (GC/MS and PTVGC/MS), the extraction yield may not be total and the values under-estimated. On the other hand, based on this semi-quantitative analysis, the response factor of the species detected is assumed to be equal to that of the internal standard, which is not always accurate.

2. Results

Stability

Tables IV and V show the results of the study of stability of the bags under SEC 1 and SEC 2 conditions respectively, each time with the reference results (glass vials).

Generally, the results show that NIgG is not destabilized in the bags after 3 months at 25° C. and 40° C., compared with storage in glass vials. The increase in the content of polymers and fragments at 40° C. is comparable in the bags and the glass vials. Anti-HBS activity is reduced by the same proportions in the bags and the glass vials. No clear change is observed in AAC, the different results being linked to the variability of the test. In this study, the use of an all-aluminium over-bag proved effective in preventing water losses. The Ig concentration and the osmolality do not increase after 3 months of storage in a bag with an over-bag.

Extractables

As regards the extractables study for the non-irradiated bags, the main entities detected are Irganox 1076, Irganox 1010, Irganox 1330, Irgafos 168 and oxidized Irgafos 168, at concentrations less than the limit of 1 ppm fixed by the European Pharmacopoeia, for extractions in aqueous medium and at very low concentrations for extraction in ethanol. In the case of the γ-irradiated bags, volatile compounds have been identified by HS-GC/MS and semi-volatiles by GC/MS, conventionally known as degradation products or solvents of the polymers.

Leachables

Tables VI and VII below show the changes in the content of volatile compounds detected in bags filled with 5% NIgG, after storage for three months, at 25° C. and at 40° C. respectively. The values are expressed in ppb.

TABLE VI

Changes in the content of volatile compounds at 25° C.

| Time (months) | 0 | 1 | 3 |
|---|---|---|---|
| Isobutylene | 12 | 7 | 9 |
| Cyclohexane | 43 | 24 | 17 |
| Ethyl acetate | 0 | 170 | 180 |

TABLE VI

| Changes in the content of volatile compounds at 40° | | | |
|---|---|---|---|
| Time (months) | 0 | 1 | 3 |
| Isobutylene | 12 | 8 | 12 |
| Cyclohexane | 43 | 17 | 14 |
| Ethyl acetate | 0 | 210 | 190 |
| Acetone | 0 | 0 | 5 |
| Terbutanol | 0 | 0 | 6 |

For the majority of the compounds, the values detected are of the order of ppb and close to the detection limit of the method (5 ppb); the differences between the time points are not significant. These are degradation products of the polymers, identified in the extractables study and solvents of the polymers used during the production of the bags. Only the change in the ethyl acetate content is significant. Whereas this solvent is not detected initially, it is released after 1 month of storage, at concentrations which remain low.

Tables VIII and IX below show the changes in the content of volatile compounds detected in bags filled with 5% NIgG, after storage for three months, at 25° C. and at 40° C. respectively. The values are expressed in ppb.

TABLE VIII

| Changes in the content of semi-volatile compounds at 25° C. | | | |
|---|---|---|---|
| Time (months) | 0 | 1 | 3 |
| 2,4-di-ter-Butylphenol | 25 | 240 | 200 |

TABLE IX

| Changes in the content of semi-volatile compounds at 40° C. | | | |
|---|---|---|---|
| Time (months) | 0 | 1 | 3 |
| 24-di-ter-Butylphenol | 25 | 130 | 110 |

TABLE IX-continued

| Changes in the content of semi-volatile compounds at 40° C. | | | |
|---|---|---|---|
| Time (months) | 0 | 1 | 3 |
| Benzyl alcohol | 0 | 0 | 11 |
| Ethylhexanoic acid | 0 | 14 | 15 |
| Unknown | 0 | 0 | 18 |
| Bislactone | 0 | 44 | 110 |
| Terbutyl-oxaspirodecadienedione | 0 | 20 | 40 |
| (ter-butyl-hydroxyphenyl) propionic acid | 0 | 19 | 34 |

Here too, for the majority of the compounds detected, the values are not significant and close to the detection limit (10 ppb). Two compounds have significant contents after storage for a month: 2,4-di-terbutylphenol (CAS 96-76-4), a product of degradation of the antioxidants, very commonly found in plastic bags. It is an irritant but not known to be carcinogenic. Bislactone (CAS 6607-34-7) is a leachable for which no toxicity data are available. Terbutylphenol had been identified in the extractables whereas bislactone, did not always appear, only after long exposure.

As regards the non-volatile compounds found by PTV-GC/MS and LC/UV (antioxidants), the 5 antioxidants identified in the extractables study were sought. Their presence beyond the detection limit was not revealed.

Conclusion

The results of the stability study show that NIgG is not destabilized in Inerta 101 bags after 3 months at 25° C. and 40° C., compared with storage in glass vials. The leachables study shows the satisfactory chemical inertness of the Inerta 101 bag. Only one solvent of the polymers, ethyl acetate and a product of degradation of an antioxidant conventionally found in plastic bags, terbutylphenol, were detected at very low levels (of the order of ppb).

The use of the aluminium over-bag is effective in blocking water diffusion through the membrane.

TABLE II

| Analyses | Acceptance criteria | Tbp | Tap | T0 | 1 month | 2 months | 3 months | 4 months | 6 months |
|---|---|---|---|---|---|---|---|---|---|
| Appearance of the solution: degree of opalesence | clear | clear | clear | clear | clear | clear | clear | clear | clear |
| Appearance of the solution: colour | practically colourless, yellow (Y, YB ≥ YG3) | YB3 | YB3 | YB3 | YB3 | YB3 | YB3 | YB3 | YB3 |
| Presence of water between bag and over-bag | NA | NA | NA | absence | absence | absence | absence | presence of a few drops | absence |
| pH | 6.7-7.3 | 7.0 | 6.9 | 7.0 | 7.0 | 6.9 | 7.0 | 6.9 | 6.9 |
| Osmolality | 200-300 mOsmol/kg | 218 | 220 | 221 | 219 | 219 | 220 | 219 | 222 |
| Total proteins | 190-210 g/1 | 201 | 202 | 204 | 204 | 205 | 204 | 204 | 201 |
| Sodium | 114-126 mmol/1 | 116 | 119 | 119 | 122 | 120 | 120 | 118 | 121 |
| Degradation products | ≤5% | <5 | <5 | <5 | <5 | <5 | <5 | <5 | <5 |
| Sodium caprylate | 12.80-16.80 mg/g prot. | 15.30 | 14.62 | 14.20 | 15.17 | 14.76 | 15.19 | 14.84 | 15.03 |
| Extractable volume | ≥50 ml | NA | NA | 51 | NA | NA | 51 | NA | 51 |
| Polymers and aggregates | ≤5% | 4 | 4 | 4 | 4 | 4 | 4 | 4 | 4 |
| Aluminium | ≤200 μg/l | NA | NA | <10 | <10 | <10 | <10 | <10 | <10 |
| Prekallikreine activator | ≤35 IU/ml | <1 | <1 | <1 | <1 | <1 | <1 | <1 | <1 |
| Sterility | sterile | NA | NA | sterile | NA | NA | NA | NA | sterile |
| Weight of reference bag | NA | NA | NA | 72.0 | 72.1 | 72.0 | 72.0 | 72.0 | 72.0 |

TABLE III

| Analyses | Acceptance criteria | Tbp | Tap | T0 | 1 month | 1 month | 3 months | 4 months | 6 months |
|---|---|---|---|---|---|---|---|---|---|
| Appearance of the solution: degree of opalesence | clear | clear | clear | clear | clear | clear | clear | clear | clear |
| Appearance of the solution: colour | practically colourless, yellow (Y, YB ≥ YG3) | YB3 | YB3 | YB3 | YB3 | YB3 | YB3 | YB3 | YB3 |
| Presence of water between bag and over-bag | NA | NA | NA | absence | absence | absence | absence | presence of a few drops | absence |
| pH | 6.7-7.3 | 7.0 | 7.0 | 7.0 | 6.9 | 6.9 | 6.9 | 6.8 | 6.8 |
| Osmolality | 200-300 mOsmol/kg | 218 | 221 | 220 | 220 | 219 | 222 | 220 | 222 |
| Total proteins | 190-210 g/1 | 201 | 201 | 202 | 204 | 204 | 200 | 201 | 202 |
| Sodium | 114-126 mmol/l | 116 | 118 | 117 | 118 | 118 | 120 | 120 | 120 |
| Degradation products | ≤5% | <5 | <5 | <5 | <5 | <5 | <5 | <5 | <5 |
| Sodium caprylate | 12.80-16.80 mg/g prot. | 15.30 | 16.57 | 14.78 | 14.78 | 14.73 | 15.76 | 13.95 | 15.18 |
| Extractable volume | ≥100 ml | NA | NA | 102 | 104 | 102 | 102 | 100 | 100 |
| Polymers and aggregates | ≤5% | 4 | 4 | 4 | 45 | 5 | 5 | 5 | 5 |
| Aluminium | ≤200 μg/1 | NA | NA | <10 | <10 | <10 | <10 | <10 | <10 |
| Prekallikreine activator | ≤35 IU/ml | <1 | <1 | <1 | <1 | <1 | <1 | <1 | <1 |
| Sterility | sterile | NA | NA | sterile | NA | NA | NA | NA | NP(1) |
| Weight of reference bag | NA | NA | NA | NP(2) | NP(2) | NP(2) | NP(2) | NP(2) | NP(2) |

TABLE IV

| Analyses | Specifications (Internal standards) | T0 | T1 | T3 |
|---|---|---|---|---|
| BAGS | | | | |
| Appearance of the solution | — | NTR | Whitish particles* | NTR |
| pH | 4.6-5.0 | 4.7 | 4.8 | 4.7 |
| Osmolality, mOsm/kg | 270-330 | 310 | 311 | 311 |
| Total proteins, g/l | 45-55 | 51 | 51 | 50 |
| HPSEC | | | | |
| % Polymers | ≤1.00 | <LOD** | <LOD** | <LOD** |
| % Dimers | ≤8.0 | 6.25 | 6.37 | 5.34 |
| % Monomers | ≥90.0 | 93.46 | 93.26 | 94.22 |
| % Fragments | ≤0.70 | 0.29 | 0.37 | 0.44 |
| Anti-Hbs | ≥0.03 IU/ml | 4.33 | 4.10 | 3.92 |
| AAC | ≤50% | 40% | 40% | 38% |
| Tween 80 assay | 20.0-50.0 mg/l | | | |
| GLASS VIALS | | | | |
| Appearance of the solution | — | NTR | NTR | NTR |
| pH | 4.6-5.0 | 4.7 | 4.7 | 4.6 |
| Osmolality, mOsm/kg | 270-330 | 310 | 308 | 308 |
| Total proteins, g/l | 45-55 | 50 | 50 | 49 |
| HPSEC | | | | |
| % Polymers | ≤1.00 | <LOD** | <LOD** | <LOD** |
| % Dimers | ≤8.0 | 6.41 | 6.45 | 6.06 |
| % Monomers | ≥90.0 | 93.32 | 93.20 | 93.51 |
| % Fragments | ≤0.70 | 0.27 | 0.34 | 0.43 |
| Anti-Hbs | ≥0.03 IU/ml | 4.47 | 4.24 | 3.85 |
| AAC | ≤50% | 42% | 56% | 39% |
| Tween 80 assay | 20.0-50.0 mg/l | | | |

*Probable microbial contamination during storage of the sample before analysis

**LOD = 0.05%

TABLE V

| Analyses | Specifications (Internal standards) | T0 | T1 | T3 |
|---|---|---|---|---|
| BAGS | | | | |
| Appearance of the solution | — | NTR | NTR | NTR |
| pH | 4.6-5.0 | 4.7 | 4.7 | 4.7 |
| Osmolality, mOsm/kg | 270-330 | 310 | 309 | 311 |
| Total proteins, g/l | 45-55 | 51 | 50 | 49 |
| HPSEC | | | | |
| % Polymers | ≤1.00 | <LOD** | 0.07 | 0.21 |
| % Dimers | ≤8.0 | 6.25 | 5.31 | 5.32 |
| % Monomers | ≥90.0 | 93.46 | 93.74 | 92.63 |
| % Fragments | ≤0.70 | 0.29 | 0.89 | 1.84 |
| Anti-Hbs | ≥0.03 IU/ml | 4.33 | 3.60 | 2.78 |
| AAC | ≤50% | 40% | 42% | 36% |
| Tween 80 assay | 20.0-50.0 mg/l | | | |
| GLASS VIALS | | | | |
| Appearance of the solution | — | NTR | NTR | Blackish particles* |
| pH | 4.6-5.0 | 4.7 | 4.7 | 4.7 |
| Osmolality, mOsm/kg | 270-330 | 310 | 311 | 311 |
| Total proteins, g/l | 45-55 | 50 | 50 | 50 |
| HPSEC | | | | |
| % Polymers | ≤1.00 | <LOD** | 0.08 | 0.29 |
| % Dimers | ≤8.0 | 6.41 | 5.89 | 5.82 |
| % Monomers | ≥90.0 | 93.32 | 93.17 | 92.09 |
| % Fragments | ≤0.70 | 0.27 | 0.86 | 1.79 |
| Anti-Hbs | ≥0.03 IU/ml | 4.47 | 3.41 | 2.76 |
| AAC | ≤50% | 42% | 53% | 38% |
| Tween 80 assay | 20.0-50.0 mg/l | | | |

*Probable microbial contamination during storage of the sample before analysis

**LOD = 0.05%

What is claimed is:

1. Assembly comprising:

a bag (10) for storing therapeutic solution comprising: at least one compartment (11) for receiving solution defined by a membrane (12), and at least one appendage (13) forming an extension of the membrane (12) and comprising an inscription area (14), and a therapeutic solution in the compartment (11) of the bag (10), an outer impervious removable and fully opaque envelope for the storage of the bag (10).

2. Assembly according to claim 1, wherein the membrane (12) is transparent.

3. Assembly according to claim 1, wherein the membrane (12) comprises one or more ports (16).

4. Assembly according to claim 1, wherein the membrane (12) is a multilayer membrane.

5. Assembly according to claim 1, wherein the outer impervious and fully opaque envelope is constituted by a multilayer film containing a layer of aluminium surrounded on both sides by a layer of plastic.

6. Assembly according to claim 1, wherein the compartment has a maximum holding capacity comprised between one milliliter and one liter.

7. Assembly according to claim 1, wherein the compartment has a maximum holding capacity comprised between 5 and 500 milliliters.

8. Assembly according to claim 1, wherein the compartment has a maximum holding capacity comprised between 10 and 500 milliliters.

9. Assembly according to claim 1, wherein the compartment has a maximum holding capacity comprised between 20 and 200 milliliters.

10. Assembly according to claim 1, wherein the compartment has a maximum holding capacity comprised between 50 and 100 milliliters.

11. Assembly according to claim 1, wherein the therapeutic solution is a solution of albumin or a solution of immunoglobulin.

12. Assembly according to claim 11, wherein the immunoglobulin is normal immunoglobulin G (NIgG).

13. Assembly according to claim 1, wherein a weld between the membrane (12) and each appendage (13) provides flexibility of each appendage (13).

14. Assembly according to claim 1, wherein a closure member (18) is attached to at least one port (16) for closing the at least one port (16).

15. Assembly according to claim 1, wherein said closure member (18) includes a removable part (20) of the closure member (18).

16. Method for manufacturing bag (10) for storing therapeutic solution according to claim 1 comprising the steps of:

(i) simultaneous formation of the membrane and the appendage, (ii) formation of the compartment by welding, (iii) perforation of the storage bag and optionally formation of a fastening device, (iv) insertion of ports, and sealing of the ports.

17. Method for manufacturing the assembly according to claim 1 comprising the following steps:

(i) filling the storage bag with a therapeutic solution, (ii) sealing the storage bag filled with the therapeutic solution by means of a closure member, (iii) visual inspection of the storage bag filled with the therapeutic solution and closed by means of the closure member, (iv) applying inscriptions to the appendage of the storage bag containing the therapeutic solution, thus visually expected, (v) optionally outer packaging of the storage bag containing the therapeutic solution by means of an outer envelope, and (vi) optionally applying inscriptions to the outer envelope containing the storage bag.

18. Method according to claim 17 comprising a step of irradiation of the storage bag before the filling step (i).

19. Assembly according to claim 1, wherein the outer impervious removable and fully opaque envelope is thermos-formed around the storage bag (10).

* * * * *